United States Patent [19]

Griffith

[11] 4,352,348

[45] Oct. 5, 1982

[54] SOCCER BALL PRACTICE MACHINE

[76] Inventor: Lawrence L. Griffith, 4720 Nambe Dr., Las Vegas, Nev. 89121

[21] Appl. No.: 155,950

[22] Filed: Jun. 3, 1980

[51] Int. Cl.[3] ..... F41B 15/00

[52] U.S. Cl. ..... 124/78; 124/34; 124/51 R; 221/205; 273/411

[58] Field of Search ..... 124/78, 34, 41 R, 49, 124/51 R, 81, 1; 273/26 D, 411; 221/205

[56] References Cited

U.S. PATENT DOCUMENTS

| | | | |
|---|---|---|---|
| Re. 28,462 | 7/1975 | Halstead | 124/1 |
| 1,211,738 | 1/1917 | Marty . | |
| 3,272,397 | 9/1966 | Bean | 222/200 |
| 3,538,900 | 11/1970 | Samuels | 124/78 |
| 3,604,409 | 9/1971 | Doeg | 124/1 |
| 3,777,732 | 12/1973 | Holloway et al. | 124/78 |
| 3,785,358 | 1/1974 | D'Angelo et al. | 124/78 |
| 3,794,011 | 2/1974 | Newgarden | 124/78 |
| 4,025,071 | 5/1977 | Hodges | 273/29 A |
| 4,026,261 | 5/1977 | Paulson et al. | 124/78 |
| 4,086,903 | 5/1978 | Scott | 124/78 |

FOREIGN PATENT DOCUMENTS

| | | | |
|---|---|---|---|
| 2262880 | 6/1974 | Fed. Rep. of Germany | 124/78 |

*Primary Examiner*—Richard C. Pinkham
*Assistant Examiner*—William R. Browne
*Attorney, Agent, or Firm*—Knobbe, Martens, Olson, Hubbard and Bear

[57] ABSTRACT

A soccer ball practice machine includes a pair of juxtaposed, oppositely rotating wheels for propelling a soccer ball toward a soccer player to facilitate the practice and instruction of a wide variety of soccer skills. The orientation of these wheels can be selectively varied to permit the soccer ball to be propelled in an infinite number of directions. In addition, the distance separating the rotating juxtaposed wheels can also be adjusted to accommodate soccer balls of varying diameters and can be automatically increased to prevent damage to oversized balls due to engagement by the wheels. A large hopper includes a rotating auger which successively feeds soccer balls in the hopper into a flexible feed tube and down a rigid ball chute where they are engaged by the wheels and propelled outwardly. The flexibility of the feed tube and the rigidity of the ball chute provide accurate delivery of the balls to the wheels and confinement of the balls on all sides as they are engaged and propelled by the wheels, even though the positions of the wheels relative to the hopper may be changed to vary the direction of the ball's flight.

3 Claims, 10 Drawing Figures

Fig. 1
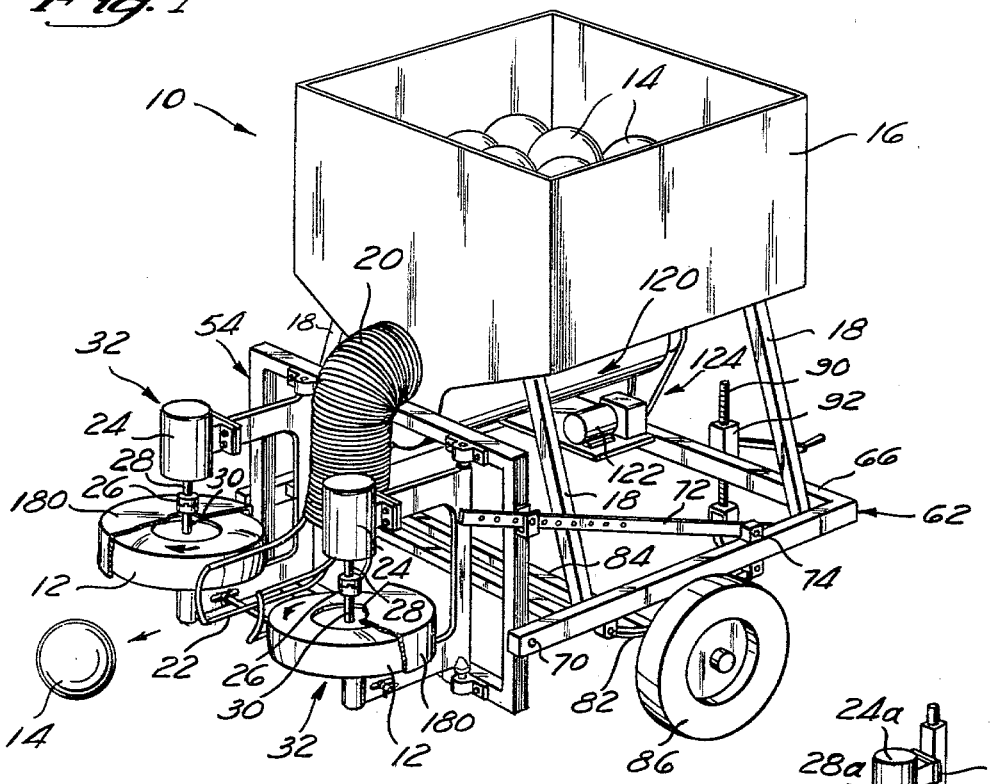
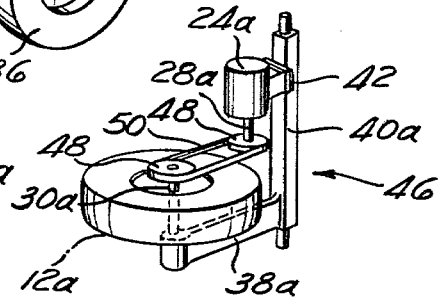
Fig. 2a
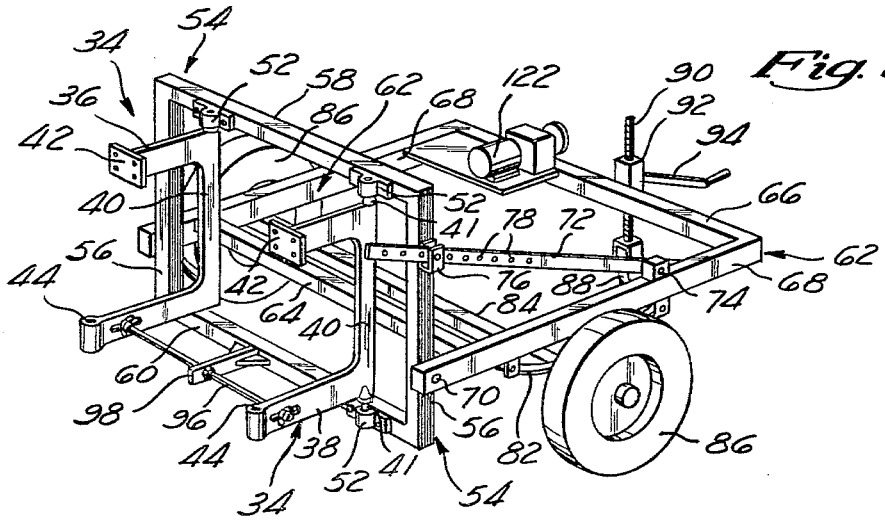
Fig. 2

Fig. 5
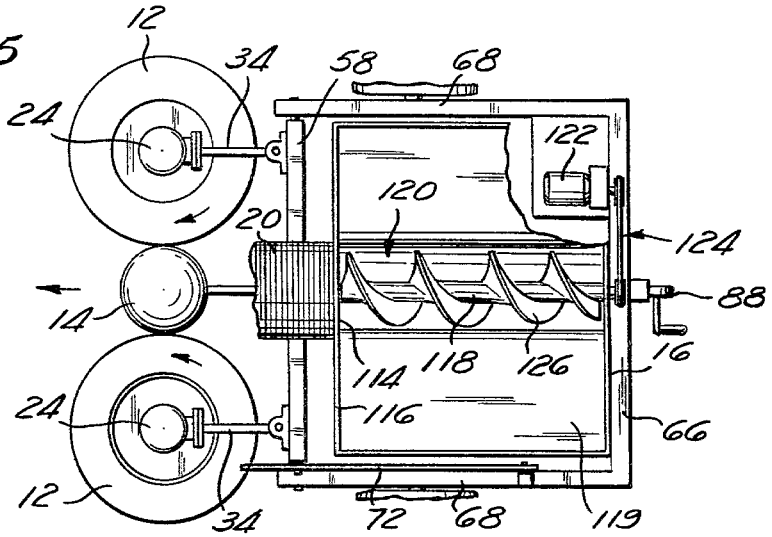
Fig. 6
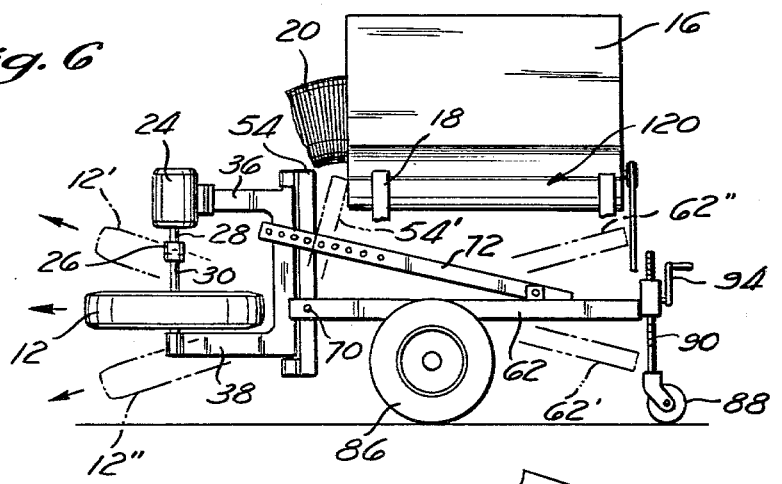
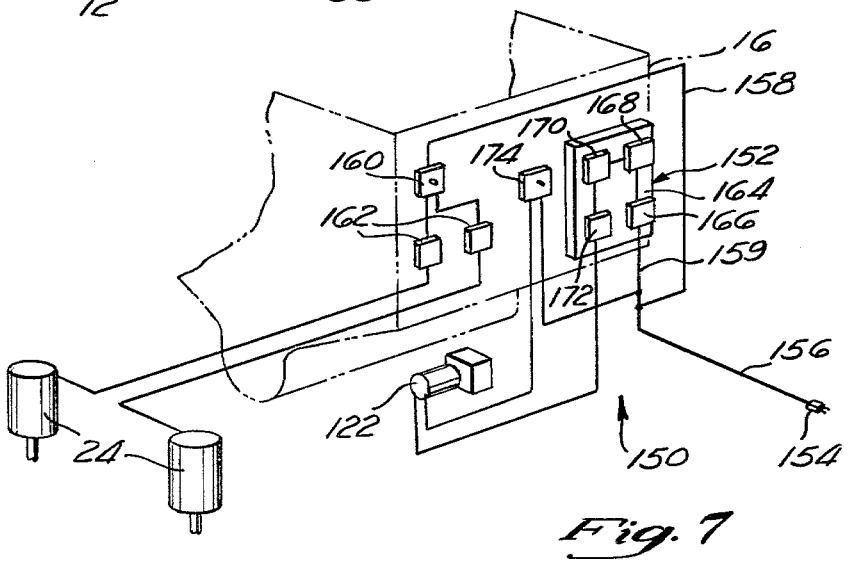
Fig. 7

Fig. 9
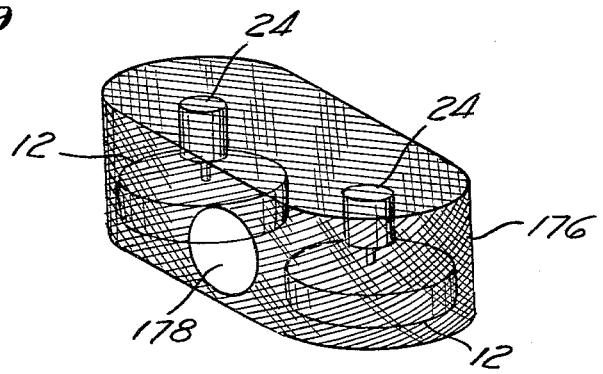
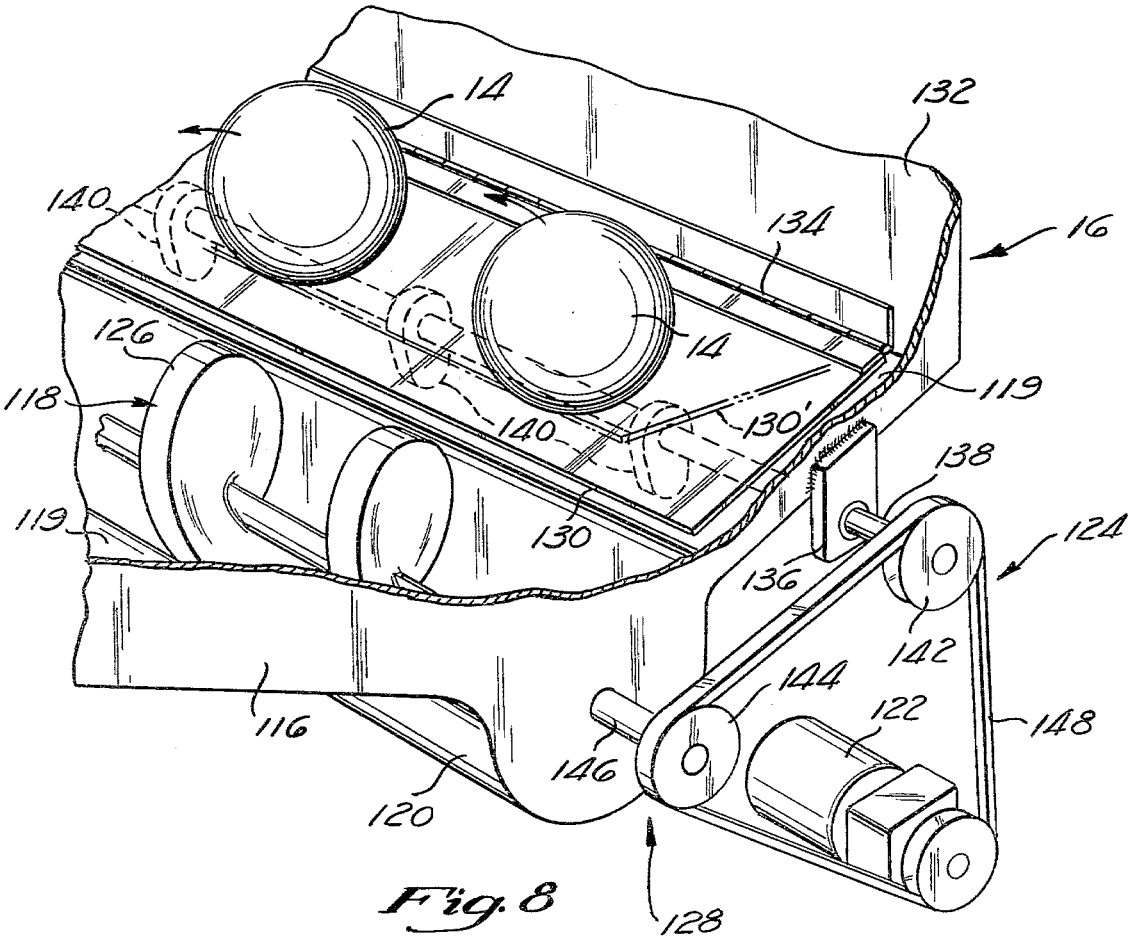
Fig. 8

SOCCER BALL PRACTICE MACHINE

BACKGROUND OF THE INVENTION

The sport of soccer has grown tremendously in popularity and participation during the past few years. As a result, numerous soccer leagues for players of both sexes and all ages have been organized in cities nationwide, and a large effort has been put forth to train these players, novice and otherwise, in the finer skills of this sport.

Soccer, however, is significantly different from most sports since it emphasizes, with the exception of a goal keeper position, the use of the body and feet rather than the hands. Thus, for example, it often becomes necessary for a soccer player to stop a moving ball with various parts of his body, including the head, chest, shoulder, thigh, or foot. Adding to the difficulty of this maneuver, known as "trapping", is the fact that the ball may be traveling in virtually any direction and a variety of speeds. In addition, the ball may be spinning rapidly, causing it to follow a curved path and making it even more difficult to trap.

Another important skill in the sport of soccer is the ability to change the direction of a moving ball without stopping it in order to pass the ball to a teammate or to attempt to shoot the ball into the opponent's goal. Again, a skilled player must be capable of executing such maneuvers with almost any part of the body regardless of the speed, direction, or spin of the ball. Furthermore, in the fast sport of soccer, a player must be able to react quickly in a particular game situation in deciding whether to trap the ball, pass it, or to take a shot on goal.

Typically, a soccer team practices such soccer skills by forming its players in a single file line and having the coach kick or throw the ball toward the players one at a time. Each player in turn executes the particular maneuver being practiced and then returns to the end of the line and so on until each player has practiced all of the desired skills. This practice method, however, suffers from many substantial disadvantages. For example, the soccer coach, standing some distance from the players, has a very poor vantage point, thus making it difficult for him to identify specific deficiencies in the players' style. Furthermore, if the coach wishes to correct a particular error and to demonstrate the proper movement, it is necessary for him to approach the players and then to return to his former position, thereby wasting much valuable time. Moreover, oftentimes a coach is unable to propel the ball accurately so as to permit the players to execute the particular skill being practiced: Thus, repeated attempts are required until each player has had an opportunity to execute the proper maneuver. Therefore, as a result of these deficiencies, it is common for several hours to be consumed in practicing just a few basic soccer skills.

In the past, machines having one or two rotating wheels to propel a ball have been utilized to facilitate the practice of certain sports. Typically, such machines include a hopper containing a number of balls which are gravity fed to a location near the rotating wheels. The wheels then engage the ball and cause it to be propelled toward the players.

Although such machines are in common use today, they are designed and constructed only for sports in which relatively small, uninflated balls, such as baseballs and tennis balls are used. These machines therefore do not adequately meet the particular problems associated with propelling larger inflated balls, such as soccerballs. For example, overinflation can cause a soccer ball to be slightly larger than similar balls of the same nominal diameter. Present practice machines, however, are not provided with means for protecting such oversized balls since the uninflated balls they shoot are not damaged by their rotating wheels. Examples of such prior art machines are disclosed in U.S. Pat. Nos. Re 28,462 to Halstead and 3,604,409 to Doeg. Furthermore, although these prior devices disclose the use of variable-speed wheel motors to vary the speed or spin of the balls they shoot, none do so in connection with shooting a soccer ball. In addition, such devices are capable of shooting only a single, standard-sized ball, whereas several sizes of soccer balls may be used depending on the age of the players.

Furthermore, in order to change the direction in which such prior art machines shoot the balls, it is necessary to move the hopper as well as the rotating wheels. This is not difficult where, as in the prior art, the machines utilize relatively small hoppers which are still capable of containing many of the smaller tennis balls or baseballs. The devices shown in U.S. Pat. Nos. 4,086,903 to Scott and 3,794,011 to Newgarden are illustrative of this point. However, for these prior art machines to hold the same number of soccer balls, their hoppers would have to be much larger and therefore much more difficult to move when a change of ball direction is desired.

For these and other reasons, the prior art does not fill the need for a practice machine suited for propelling large, inflated balls, such as soccer balls.

SUMMARY OF THE INVENTION

The present invention relates to a soccer ball practice machine for propelling a soccer ball at virtually any speed or direction in order to greatly facilitate the practice and perfection of soccer skills. The present machine utilizes a pair of juxtaposed rotating wheels whose spacing can accomodate balls of varying diameters. This is an important advantage since, as mentioned above, soccer players within different age groups typically use differently sized balls, older players using larger diameter balls and younger players using smaller diameter balls.

Another feature of the present invention is that the spacing between the juxtaposed wheels is automatically adjusted to compensate for an oversized ball, thereby preventing damage to the ball due to engagement by the wheels. Furthermore, many balls can be collected in a large hopper and individually fed to the wheels through a flexible feed tube, which eliminates the need to move the hopper in order to vary the direction of the propelled balls.

The soccer ball machine of the present invention can be advantageously adjusted to closely simulate actual soccer game conditions. For example, the rotating, juxtaposed wheels, which engage and propel the soccer balls toward the players, are individually powered by a pair of motors respectively connected to the wheels so as to form two motor/wheel assemblies. Thus, the speed at which the wheels propel the balls can be controlled by varying the rate of the angular rotation of these motors. Also, since the wheels are individually powered, they can be caused to rotate with different angular velocities, thereby imparting a spin to the ball and causing it to travel in a curved path.

The present invention also automatically feeds soccer balls into the proper position between the wheels. This system includes a large hopper which is mounted on the horizontal frame of the machine so as to be disposed above the wheels. A rotating auger is recessed into the floor of the hopper and serves to individually transport the balls in the hopper toward an exit opening in the front of the hopper. Upon exiting, the balls enter a flexible feed tube which conducts them into a rigid chute where they are delivered to the spinning wheels. One section in the floor of the hopper reciprocates vertically in response to contact by three synchronously rotating cams, thereby providing means for agitating balls in the hopper to insure proper feeding.

This ball feeding system enjoys several significant advantages. For example, the large hopper is capable of receiving and containing many of the large soccer balls, thereby eliminating the need for frequent refilling. The rotating auger provides for the automatic feeding of the soccer balls to the wheels so that manual attention is not necessary. Furthermore, the agitator in the hopper insures that the large, light soccer balls will not become clogged or blocked within the hopper and prevented from falling down into the blades of the auger.

Moreover, in the present practice machine, the rigid ball chute extends beyond the point of engagement by the wheels in order to confine the ball on all sides as it is contacted and propelled by the wheels, otherwise their size and inflatedness could cause them to lose contact with or suffer misengagement by the wheels.

An important feature of the present invention is the ability of the flexible feed tube to efficiently deliver the balls to the wheels regardless of the relative positions of the hopper and the wheels. Since the orientation of the wheels determines the direction of the balls' flight, the position of the wheels will naturally be varied from time to time to permit the practicing of a wider variety of soccer skills. If the feed tube to the wheels were entirely rigid, this would require that the large hopper move as a unit with the wheels (as in prior machines), greatly increasing the inconvenience and difficulty associated with changing the direction of the balls' flight. The flexibility of the feed tube, however, advantageously permits the wheels and the hopper to be moved independently of one another, thereby facilitating changes in the direction of the ball. Therefore, since the hopper need not be moved in effecting direction changes, it can be large enough to contain a number of soccer balls.

The soccer ball practice machine of the present invention substantially accelerates the instruction, practice, and perfection of virtually all soccer skills. Once the hopper is full of balls and the auger is rotating, the operation of the present machine is entirely automatic, permitting the coach to position himself near the players receiving the thrown soccer balls. The coach therefore has a much improved vantage point and can easily instruct and demonstrate the proper soccer skills and techniques. Furthermore, the machine is capable of propelling the ball so as to closely simulate actual game conditions. That is, the ball can be selectively thrown in an infinite number of directions and can cover distances of 30 to 50 yards. Moreover, it may be propelled at speeds of up to 80 miles per hour and exhibit a variety of spins and curves. A very important advantage lies in the present machine's ability to consistently throw the ball in the desired manner so that valuable time is not wasted in practicing a particular technique. Thus, skills can be more efficiently practiced in a fraction of the time required under prior methods.

In addition, in the practice machine of the present invention, the rotation of the auger can be remotely controlled by, for example, radio signals produced by a hand held transmitter. Thus, the coach can selectively and remotely cause the auger to rotate to allow the machine to shoot the balls toward the players, or he can stop the auger in order to instruct or comment on the action. Furthermore, the present invention is adapted to permit the remote control of several other aspects of the machine's operation. For example, the rotational rate of the auger can be controlled by remotely transmitted radio signals to vary the time interval between the thrown balls. This feature permits the coach to increase this interval for the benefit of novice players or to decrease the interval to test the reactions and reflexes of more experienced players. Similarly, the direction, velocity, and speed of the thrown balls can also be remotely controlled by the application of simple, well known principles.

In conclusion, the soccer ball practice machine of the present invention greatly facilitates the instruction and practice of essential soccer techniques.

DESCRIPTION OF THE DRAWING

FIG. 1 is a perspective view of the soccer ball practice machine of the present invention showing a soccer ball in flight;

FIG. 2 is another perspective view of the present invention which has been simplified to disclose the details of its construction, including the manner in which the rotating wheels are mounted;

FIG. 2A is a perspective view illustrating an alternative method for mounting the rotating wheels;

FIG. 5 is a top plan view of the present machine illustrating the rotating auger mounted in the bottom of the hopper;

FIG. 6 is a side view of the present invention demonstrating the manner in which the direction of the ball's flight can be varied;

FIG. 7 is a schematic view illustrating the electrical control system of the present machine;

FIG. 8 is a perspective view of the rear of the hopper with the end removed to reveal the details of the agitator mechanism; and FIG. 9 is a perspective view of a screen safety device which can be utilized with the present invention.

DETAILED DESCRIPTION OF THE INVENTION

General Construction of the Invention

Figure 3:
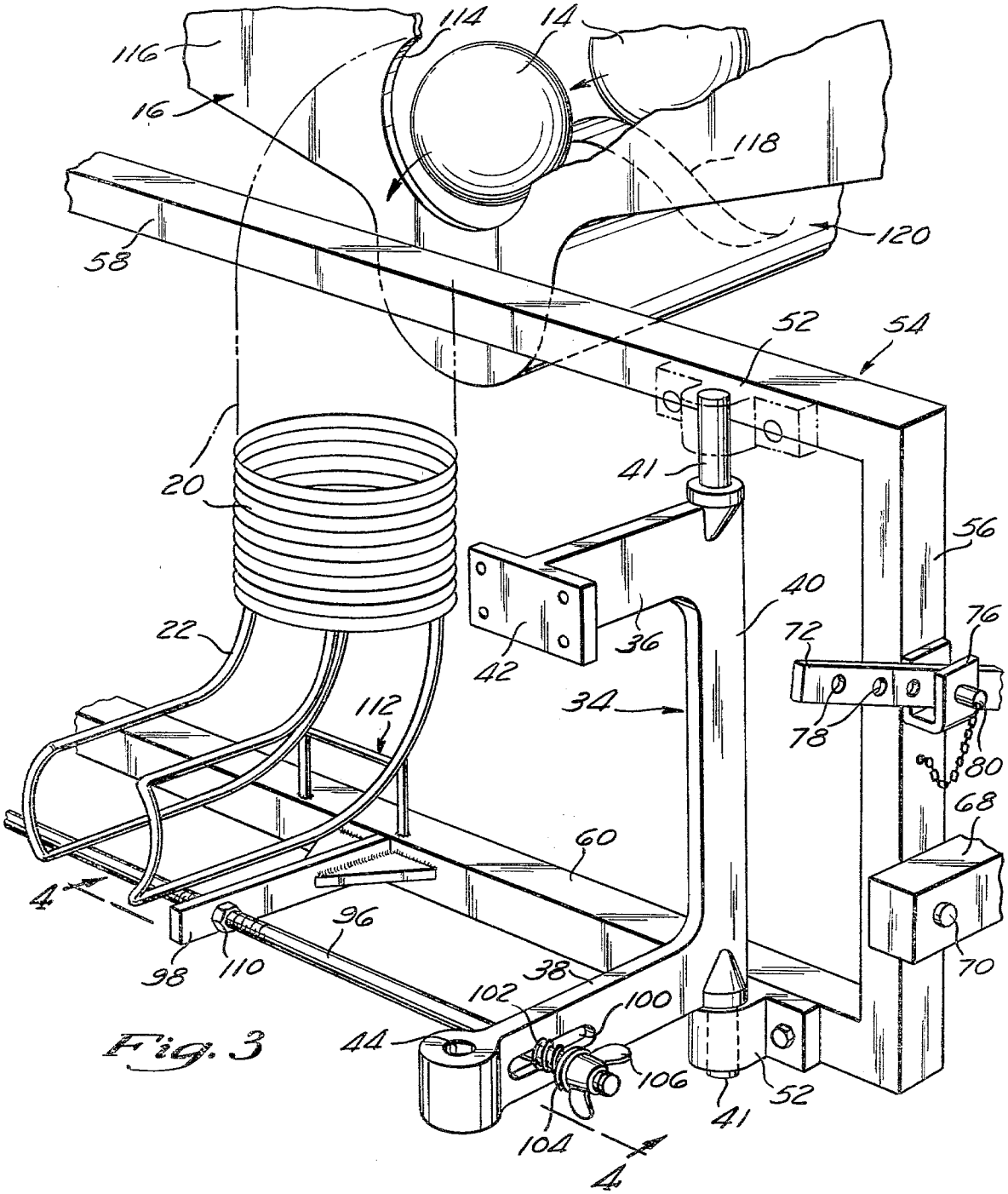
FIG. 3 is a perspective view of the front end of the present machine illustrating in detail the ball feeding system thereof.

FIG. 1 illustrates the soccer ball practice machine 10 of the present invention which includes a pair of rotating wheels 12 used to propel a soccer ball 14 toward a soccer player. The wheels 12 respectively rotate in reverse directions, as shown by the arrows in FIG. 1, and are appropriately spaced so that a soccer ball 14 engaged between them is swiftly propelled or shot outward, as shown. The wheels 12 are preferably 20 inches in diameter and comprised of inflated rubber tires, so as to prevent damage to the soccer balls, although other appropriate wheel means can be utilized.

A large hopper 16 is mounted on stilts 18 so as to be disposed above and to the rear of the rotating wheels 12. As shown in FIG. 1, the hopper 16 is sufficiently large to contain numerous soccer balls 14. As will be described in more detail below, the soccer balls 14 are automatically, individually fed out of the hopper 16, into a flexible feed tube 20, and out through a rigid frame-like ball chute 22, which delivers the balls to the proper location for engagement and propulsion by the wheels 12. Thus, the automatic operation of the present practice machine 10 advantageously permits the soccer coach to position himself near the players for efficient instruction and demonstration of soccer techniques.

The wheels 12 are individually powered by a pair of motors 24, as shown in FIG. 1. Flexible couplings 26 connect the drive shafts 28 of the motors 24 to the upper portion of the stub axles 30 of the wheels 12, thereby forming unitary motor/wheel assemblies 32. Each of these motor/wheel assemblies 32 and their mounting on the present machine (described below) are similar in construction. The rate of angular rotation of the wheels 12, and hence the speed or velocity with which the soccer ball 14 is propelled, can be controlled by varying the revolutions per minute (RPM) of the motors 24. Preferably, the motors 24 are capable of turning at 1,725 RPM, which is sufficient to propel an average size soccer ball a distance of 30 to 50 yards at a speed of up to 80 miles per hour. Furthermore, since the wheels 12 are individually powered by the motors 24, they can be caused to turn at different angular velocities, thereby imparting a spin on the ball and causing it to travel in a curved path. Thus, the present soccer ball practice machine 10 serves to acurately simulate game conditions by shooting a soccer ball with a variety of velocities, distances, and spins.

FIG. 2 illustrates the present invention in which the motor/wheel assemblies 32 and the hopper 16 have been removed to reveal the sub-structure on which these elements are mounted. The motor/wheel assemblies 32 are individually mounted on a pair of aligned, U-shaped wheel mounts 34 which extend toward the front of the machine 10. Each of these wheel mounts 34 are similar in construction and are comprised of an upper and lower horizontal arm, 36 and 38 respectively, which are separated by a vertical member 40. The upper arm 36 is provided with a flange 42 which serves to mount the motor 24 of the motor/wheel assembly 32, and the end of the lower horizontal arm 38 has an opening 44 to receive the bottom portion of the stub axle 30 of the wheel 12.

Although other constructions are possible, the wheel mounts 34 are preferably comprised of a single piece casting. This construction permits the opening 44 in the lower arm 38 to be accurately drilled in a location relative to the flange 42 on the upper arm 36 to insure proper alignment between the drive shaft 28 of the motor 24 and the stub axle 30 of the wheel 12. Even though a flexible coupling 26 is utilized to connect the drive shaft 28 to the stub axle 30, it is important that these elements be accurately aligned to insure that the wheel 12 will maintain proper balance at high RPM. That is, at a high RPM an imbalanced wheel 12 tends to wobble, resulting in possible damage to bearings in the wheels 12 and the motors 24. Furthermore, such a wobble in the wheel 12 would cause the soccer ball to be misengaged by the wheels 12 and thus propelled in an inaccurate direction.

FIG. 2A depicts an alternate wheel mount configuration designed to eliminate wheel wobbling, even at higher RPM's, without requiring accurate wheel/motor alignment. This wheel mount 46 is L-shaped since it is provided with no upper horizontal arm. The motor 24 is mounted on a flange 42 which is attached directly to the vertical member **40*a* of the wheel mount 46. The wheel 12*a*, as in FIG. 2, is mounted on the lower horizontal arm 38*a*. The drive shaft 28*a* of the motor 24*a* and the stub axle 30*a* of the wheel 12*a* are each provided with pulleys 48 which are connected by a belt 50, as shown in FIG. 2A. Thus, the need for accuracy in the alignment between the drive shaft 28*a* and the stub axle 30*a*** is eliminated by means of the belt and pulley arrangement.

FIGS. 2 and 3 illustrate the frame configurations of the present machine on which the wheel mounts 34 and hopper 16 are mounted. The opposite ends 41 of the vertical member 40 of each wheel mount 34 are journaled in a pair of bearings 52 located on a generally vertical frame 54. As will be described below, this rotational mounting of the wheel mounts 34 provides for the adjustability of the wheel spacing in order to accomodate soccer balls of different diameters, including overinflated, oversized balls. The vertical frame 54 is rectangular in shape and is comprised of two vertical members 56 and an upper and lower cross bar, 58 and 60 respectively, on which the bearings 52 are mounted. This vertical frame 54 is, in turn, rotatively mounted on the front end of a generally horizontal frame 62. Although these frames are described herein as being vertical and horizontal, it should be clear that their orientation may be altered to change the direction in which the ball is propelled. That is, as will be described in more detail in connection with FIG. 6, the orientation of the wheels 12, and thus the direction of the propelled soccer balls, can be varied by changing the relative positions of the vertical and horizontal frames, 54 and 62, respectively.

As shown in FIG. 2, the horizontal frame 62 is also generally rectangular and comprises forward and rear transverse members, 64 and 66 respectively, and longitudinal side members 68, which support the stilts 18 on which the hopper 16 is mounted (see FIG. 1). These side members 68 extend forward of the forward transverse member 64 and serve to mount pillow block bearings (not shown) which receive a journal pin 70, as shown in FIG. 3, attached to the vertical member 56 of the vertical frame 54 at a location just above the lower cross bar 60 of the vertical frame 54. Thus, the vertical frame 54 rotates about a horizontal axis through these journal pins 70.

As shown in FIGS. 2 and 3, the position of the vertical frame 54 relative to the horizontal frame 62 can be adjusted and fixed by means of a strut 72, which is pivoted, as indicated at 74, at its lower, rear end on one of the side members 68 of the horizontal frame 62 at a location near its rear transverse member 66. From its rear pivot point 74, this strut 72 extends forwardly at an angle toward the vertical frame 54 and rests in a U-shaped bracket 76 attached to the upper portion of the vertical member 54 of the vertical frame 54, as shown in FIG. 3. This strut 72 is provided with a plurality of holes 78 which can be aligned with similarly sized holes in the U-shaped bracket 76. Thus, the vertical frame 54 can be rotated forward or backward to desired position and then fixed by inserting a pin 80 (shown in FIG. 3), through the aligned holes 78 in the strut 72 and the bracket 76. To provide extra security in maintaining the vertical frame 54 in the desired location, a second strut can be similarly disposed on the opposite side of the present machine.

Referring to FIG. 2, the side members 68 of the horizontal frame 62 are shown mounted on springs 82 (only one such spring 82 being shown) and a transverse axle 84. The axle 84 is provided with tires or wheels 86 to facilitate the placement of the present practice machine 10 in the desired location on the practice field. That is, the machine 10 is sufficiently light to permit it to be manually pushed or pulled to the proper location on the field. Furthermore, the rear transverse member 66 of the horizontal frame 62 can be provided with a hitching device (not shown) to permit the machine 10 to be towed long distances behind a vehicle.

The mounting of the horizontal frame 62 on the transverse axle 84 permits it to be rotational about that axis. However, the position of the horizontal frame 62 can be stabilized by a third, caster wheel 88, as shown in FIG. 2, which is located at the rear of the machine 10. This smaller wheel 88 is attached to a vertical shaft 90 which is inserted through a housing 92 attached to the rear transverse member 66 of the horizontal frame 62. The shaft 90 is threadedly engaged within the housing 92 and its vertical position with respect to the housing 92 can be adjusted by turning a crank 94. Thus, the rear portion of the horizontal frame 62 in the present invention can be raised or lowered by turning the crank 94, thereby affecting, at the same time, the position of the vertical frame 54 and the wheels 12.

Adjustability of the Wheel Spacing

With reference again to FIG. 2, the wheel mounts 34 for mounting the motor/wheel assemblies 32 rotate about a generally vertical axis through their vertical member 40, as explained above. The spacing between these wheel mounts 34, and thus the spacing between the wheels 12, is adjustable and maintained by means of a transverse tension rod 96 which extends between the lower arms 38 of the wheel mounts 34. This tension rod 96 is supported by a central arm 98 which is cantelevered on and extends forward from the lower cross bar 60 of the vertical frame 54.

Figure 4:
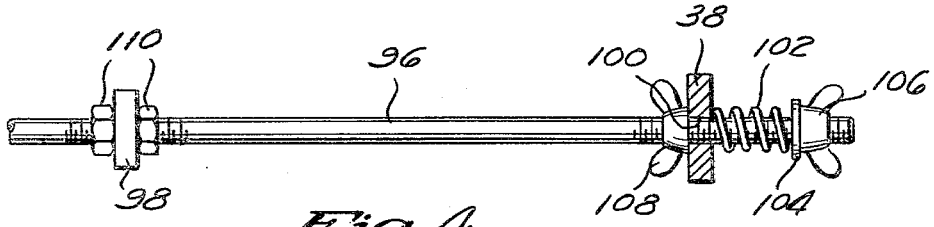
FIG. 4 is a partial view of a tension rod which provides for the adjustability of the wheel spacing to accomodate soccer balls of varying diameters.

FIGS. 3 and 4 illustrate in more detail the construction and function of this tension rod 96. As shown in FIG. 3, the threaded tension rod 96 is inserted through oblong shaped slots 100 located just behind the stub axle openings 44 in the lower arm 38 of the wheel mounts 34. Each end of the tension rod 96 is provided with a spring 102, washer 104, and wing nut 106, as shown in FIG. 4, and a second wing nut 108 is also positioned on the tension rod 96 inside of the lower arm 38. Each side of the central support arm 98 is provided with nuts 110 to prevent vibration or other lateral movement of the arm 98 with respect to the tension rod 96.

Thus, the tension rod 96 provides adjustability of the wheel spacing to permit the wheels 12 to accomodate and propel balls of varying diameters. For example, for a smaller diameter ball, the wing nuts 106 and 108 on the end of the tension rod 96 may be advanced toward the central support arm 98, thus causing the wheel mounts 34 to rotate in the same direction toward one another until the appropriate spacing between the wheels 12 is achieved for that particular ball size. Conversely, for a larger diameter ball, the wing nuts 106 and 108 are moved outwardly along the tension rod 96, causing the wheel mounts 34 to rotate in the same direction, thereby sufficiently spreading the wheels 12 to accomodate such a larger diameter ball.

Once the proper wheel spacing is achieved by adjusting the wing nuts 106 and 108 on the end of the tension rod 96, it is still possible that a ball which is slightly larger than normal will be fed between the wheels. In this event, however, the pressure of this oversized ball on the wheels 12 will cause the lower arm 38 of the wheel mounts 34 to spread apart, being permitted to do so by the springs 102. Thus, the wheels 12 are spread apart a distance sufficient to engage and propel the larger ball without damaging it. After the ball is shot, the tension of the lower arms 38 created by the springs 102 causes them to return to their original position for shooting normal sized balls. Furthermore, the amount of tension on the lower arms 38 can be varied by adjusting the position of the outer wing nut 106. Thus, the tension rod 96 permits the present practice machine 10 to automatically compensate for oversized balls, preventing them from bursting or otherwise being damaged due to their engagement by the wheels. At the same time, the tension rod 96 maintains the lower arm 38 in tension so that the wheels 12 are spread apart only that distance which is required to shoot the ball without damaging it, and then are automatically returned to their normal position.

Ball Feeding Mechanism

FIG. 3 also illustrates the feed tube 20 and ball chute 22 which serve to deliver the soccer balls 14 from the hopper 16 to the proper location between the wheels 12 for engagement and propulsion. The feed tube 20 is flexible to permit the soccer balls to be accurately transported into the ball chute 22 and into position between the wheels 12 regardless of their position relative to the hopper 16, as will be explained in more detail in connection with FIG. 6. The ball chute 22 is a frame-like structure which is sufficiently rigid to securely confine the soccer balls on all sides as they are engaged and propelled by the rotating wheels 12. In this regard, a significant feature of the rigid ball chute 22 is that it extends beyond the area of engagement of the balls by the wheels 12, as shown in FIG. 1. Unlike smaller, more solid balls, soccer balls are relatively large and light. Furthermore, since soccer balls are inflated, they can be deformed by mis-engagement with the wheels 12. Thus, it is important that the ball be properly aligned between the wheels 12 to insure that they be shot accurately. Otherwise, the balls may have a tendency to be mis-engaged, to pop up out of the wheels 12 without being propelled, or to be shot in the wrong direction. Thus, the rigid ball chute 22 serves to confine the balls on all sides during engagement and propulsion of the balls to insure their proper alignment with respect to the wheels 12. Furthermore, as shown in FIG. 3, the ball chute 22 is securely attached to the lower cross bar 60 of the vertical frame 54, as indicated generally at 112, so that the chute 22 and the balls will maintain their proper orientation with respect to the wheels 12 as the position of the vertical frame 54 is changed to alter the direction of the balls' flight.

Referring again to FIG. 3, the upper end of the flexible feed tube 20 is shown communicating with the interior of the hopper 16 by means of an opening 114 in the forward end wall 116 of the hopper 16. The soccer balls 14 in the hopper are individually conveyed through this opening 114 and into the flexible feed tube 20 by means of a rotating auger 118 (shown best in the top plan view of FIG. 5), which is longitudinally recessed into the floor 119 of the hopper 16, as indicated generally at 120 in FIGS. 1 and 3. The rotation of the auger 118 is provided by a motor 122 which is mounted at the rear corner of the horizontal frame 62, as shown in FIG. 2. As shown in FIGS. 1 and 5, the drive shaft of the auger motor 122 is connected to the shaft of the auger 118 by means of a belt and pulley arrangement 124. The pitch of the auger blades 126 is sufficient to contain a single soccer ball, so that as the auger 118 is rotated the balls are successively transported through the hopper opening 114 without clogging it. The balls then fall by gravity through the feed tube 20 and into the ball chute 22 which delivers them to the proper location between the wheels 12. A significant feature of the auger 118 is that even the last ball in the hopper 16 will be fed out of the hopper 16 and delivered to the wheels 12, thus providing maximum efficiency from a single hopper-load of soccer balls.

FIG. 8, which is a rear view of the hopper 16, illustrates in detail the features of the present invention which insures continuous feeding of the soccer balls 14. For example, the sloping floor 119 of the hopper 16 causes the balls to collect in the vicinity of the auger 118 so that they will fill the spaces between the auger blades 126 and be conveyed toward the exit opening 114. The hopper 16 is also provided with an agitator mechanism 128 to prevent the "bridging" of the relatively large, light soccer balls, wherein a collection of the balls block one another from falling down into the auger blades 126 and being fed out into the feed tube 20.

As shown in FIG. 8, this agitator mechanism 128 involves the vertical reciprocation of a portion of the floor 119 of the hopper 16 so that the balls are prevented from bridging over the auger 118. A floor panel 130 on one side of the hopper 16 is hinged along the edge which is attached to the vertical wall 132 of the hopper 16, as indicated at 134. Attached to each end wall 116 of the hopper 16, just above the recessed portion 120, is a bracket 136 which mounts a longitudinal cam shaft 138 disposed parallel to the axis of the auger 118. The cam shaft 138 mounts a plurality of cams 140, such as the ones shown in FIG. 8. The rear of this cam shaft 130 is provided with a pulley 142 which is aligned with the pulley 144 of the auger shaft 146, and both pulleys 142 and 144 are engaged by the auger motor belt 148. Thus, the belt and pulley arrangement 124 (also shown in FIGS. 1 and 5), which turns the auger 118, also causes the cam shaft 138 to rotate.

With each rotation of the cam shaft 138, the rotating cams 140 contact the hinged floor panel 130 causing it to lift up, as indicated at 130' in FIG. 8. This reciprocation of the floor panel 130 causes the balls 14 to move in the direction of the arrows and thus prevents them from bridging above the auger 118. The balls are then free to enter the auger blades 126 from the side of the hopper 16 opposite this agitator mechanism 128 and thereby insures continuous feeding of the soccer balls.

Adjustability of Ball Directions

FIG. 6 depicts the manner in which the vertical and horizontal frames 54 and 62 respectively, cooperate to propel a ball in virtually an infinite number of directions, thus closely simulating game conditions. The ball will be propelled by the wheels 12 in a direction which is parallel with the plane of the wheels or perpendicular to the axis of the wheels, as indicated by the arrows in FIG. 6. Thus, in order to shoot the ball up in a high arching shot, the wheels 12 are moved to the position 12' by rotating the vertical frame 54 an appropriate distance backward to position 54', and then maintaining it there by means of the strut 72. If a still higher shot is desired, the rear of the horizontal frame 62 can be lowered into position 62' by means of the crank 94. This raises the entire front end of the machine and causes the wheels 12 to be oriented even more toward the vertical. Conversely, if it is desired to shoot the ball at a downward angle or to bounce it off of the ground, the vertical frame 54 is rotated forwardly so that the wheels 12 assume position 12''. A sharper downward angle can be achieved by raising the rear of the horizontal frame 62 to the position 62'.

Other ball directions are possible by combining movements of the vertical and horizontal frames 54 and 62 respectively. For example, the ball can be shot at only a slight downward angle, so that it approaches the player's feet, by lowering the horizontal frame 62 and then rotating the vertical frame 54 to an extreme forward position. Furthermore, the direction of the ball in a horizontal plane can be easily changed by rotating the entire machine laterally by means of the wheels 86 and the third wheel 88.

An important feature of the present invention is that, despite the relative orientation of the vertical and horizontal frames, the soccer balls will be accurately delivered to the wheels. This feature is derived from the flexibility of the feed tube 20 which conducts the balls into the rigid ball chute 22 regardless of the position of the hopper 16 with respect to the vertical frame 54. That is, the flexible feed tube 20 facilitates the changing of the direction of the ball's flight by permitting the vertical frame 54 to be easily moved without the necessity of moving the horizontal frame 62 and the large hopper 16. This permits the hopper 16 to be very large, and therefore capable of containing many soccer balls, and eliminates the need for frequent refilling. As explained above, however, the horizontal frame 62 may be moved slightly to achieve a wider variety of flight directions, although the flexible feed tube 20 permits it to be moved independently of the vertical frame 54 while still insuring accurate feeding.

Electrical System and Remote Controllability

FIG. 7 schematically illustrates the electrical system 150 of the present soccer ball practice machine, including a radio control system 152 for permitting the coach to operate the rotating auger 118 while being remotely located from the machine. The electrical system 150 can be mounted on the side of the hopper 16, as shown in FIG. 7, or at any other appropriate location. A plug type connector 154 can be connected to an electrical outlet to provide a supply line 156 for conducting an electrical current to the wheel motors 24 and the auger motor 122. A first branch 158 of this electrical line 156 is connected to a master on/off switch 160 for the auger motors 24 which is in turn connected to a pair of wheel motor control switches 162 used to individually determine the RPM of each wheel motor 24. Any one of a number of motor controllers can be utilized in the control switches 162, such as the DAYTON Model 2M171. Furthermore, any suitable motor of approximately ½ horse power, capable of delivering about 1,725 RPM can be utilized as the wheel motors 24. Once example is the Granger Model 7M002. Thus, these control switches 162 can be equally increased or decreased to vary the angular velocity of the wheels 12 and hence the velocity of the balls. On the other hand, these control switches 162 can be unequally varied to produce a spin or curve on the balls.

A second branch 159 of the electrical line 156 is connected to an electrical panel 164 of the radio control system 152, which controls the operation of the auger motor 122. A motor of about 1/20 horse power is a suitable auger motor 122, such as the Granger Model 3M328. Connected in series with this electrical line 159 is a 24 Volt AC/DC transformer 166, a radio receiver 168, a second 6 Volt transformer 170, and a relay switch 172 which is connected to the auger motor 122. Connected in parallel with the electrical line 159 is an auxiliary auger motor on/off switch 174. These elements of the radio control system are standard parts which are commercially available. For example, a common garage door type radio transmitter and receiver can be utilized, one example being the STANLEY Model 1018 Transmitter and Model 2021 Receiver.

Thus, remotely transmitted radio signals are received by the receiver 168 which serves to either actuate the auger motor 122 to feed the balls to the wheels 12 or to momentarily deactuate the operation of the auger motor 122 to permit the coach to instruct or demonstrate a particular soccer technique. The auxilliary on/-off switch 174 can be used for the manual operation of the auger 118. Furthermore, the RPM of the auger motor 122 is adjustable in order to vary the rate of rotation of the auger 118 and therefore the interval between the thrown balls. For example, the balls can be shot at rapid intervals to train the reflexes of experienced players, or they can be fed to the wheels at longer intervals for the benefit of less experienced players.

The radio control system 152 described above can also be easily applied to remotely control other phases of the present machine's operation. For example, the struts 72 maintaining the position of the vertical frame 54 can be replaced with hydraulic devices which are electrically actuated by radio signals. Thus, the soccer coach could change the direction of the ball's flight without leaving his position near the players. Also, the rotation of the wheels could be controlled in a similar manner to vary the speed and spin of the ball.

Overall Operation

The overall operation of the present soccer ball practice machine is as follows: first, the hopper 16 is filled with soccer balls 14 and the vertical and horizontal frames 54 and 62, respectively, are adjusted to shoot the balls with the desired angle and direction. The wheel motors 24 are then turned on by means of the on/off switch 160 and the rate of angular rotation of the wheels adjusted by means of the control switches 162 to provide the desired ball velocity and spin. The coach is then free to position himself where he can most effectively instruct the soccer players. The rotation of the auger 118 can be remotely controlled, for example, by means of a hand held radio transmitter. Radio signals from this transmitter are received by the receiver 168 in the electrical control panel 164 on the side of the hopper 16 causing movement of the relay switch 172 and actuation of the auger motor 122. The soccer ball in the hopper 16 are then individually fed into the feed tube 20 where they are conducted down into the ball chute 22 and into position between the wheels 12. The wheels 12 then engage each soccer ball and shoot it with the desired speed, direction, and spin toward the soccer players. This operation continues until the hopper 16 is entirely empty of soccer balls or until the coach deactuates the auger 118 by transmitting a second radio signal. The auger motor 122 is thus temporarily disconnected from the supply of electrical current, providing a pause in the operation of the machine to permit specialized instruction.

FIG. 9 illustrates a screen 176 device encircling the rotating wheels 12 and the motors 24 for insuring the safety of persons standing near the present machine. This screen 176 entirely surrounds the wheels 12, including the sides, top and bottom, leaving only a hole 178 for the discharge of soccer balls propelled by the wheels 12. Alternatively, the wheels 12 can be provided with fender devices 180, shown in FIG. 1, to prevent injury due to the rotation of the wheels.

Thus, in conclusion, the soccer ball practice machine of the present invention greatly facilitates the practice of a wide variety of soccer skills and techniques and permits their efficient instruction and demonstration.

I claim:

1. A soccer ball practice machine, comprising:

a pair of rotating wheels separated by a distance sufficient to engage a soccer ball between them and propel it toward a soccer player to facilitate the practice of soccer skills;

a hopper for containing a large number of said soccer balls;

guide means for conducting said soccer balls in said hopper from said hopper to said wheels; and a pair of mounting members for individually mounting said wheels, said mounting members being rotatably mounted to provide means for selectively increasing or decreasing said distance between said wheels to accommodate soccer balls of various diameters;

a rod between said mounting members to provide means for adjusting the rotational position of said mounting members so that said wheels are separated by a distance sufficient to engage and propel said soccer balls of various diameters; and tension means on said rod for (i) permitting said mounting members to spread apart in response to a larger soccer ball to increase said distance between said wheels by an amount sufficient to propel said larger soccer ball without damaging it, and (ii) automatically restoring said mounting members to their original position after said larger soccer ball has been propelled.

2. The soccer ball practice machine of claim 1 wherein said tension means comprises springs mounted on said rod and bearing against said mounting members.

3. A soccer ball practice machine comprising:

a pair of rotating wheels for propelling a soccer ball toward a soccer player to facilitate the practice of soccer skills;

first mounting means for mounting said wheels; said first mounting means being pivotally mounted about generally a vertical axis and limited to less than 360° rotation and which first mounting means is mounted on a pivoted frame that pivots about a substantially horizontal axis, said wheels and said first mounting means being pivoted together when said frame is pivoted;

second mounting means for rotatively mounting said first mounting means about a horizontal axis, said second mounting means also being rotatable about a horizontal axis, the relative positions of said first and second mounting means being independently adjustable with respect to one another to vary the orientation of said wheels and the direction of said soccer ball as it is propelled toward said player, the axis of said second mounting means being provided with wheels to make said practice machine trailerable behind a vehicle to provide means for facilitating transportation of said machine;

a hopper containing many of said soccer balls, said hopper being mounted on said second mounting means; and means for conducting said soccer balls in said hopper to said wheels regardless of the relative positions of said first and second mounting means.

* * * * *